United States Patent [19]

Lau et al.

[11] Patent Number: 4,496,254

[45] Date of Patent: Jan. 29, 1985

[54] METHOD AND APPARATUS FOR MOUNTING A DAISY PRINT WHEEL ON THE SHAFT OF A PRINT HEAD

[75] Inventors: Edward H. Lau, Westbury; Kenneth Colonel, Ronkonkoma, both of N.Y.

[73] Assignee: Primages, Inc., Bohemia, N.Y.

[21] Appl. No.: 476,502

[22] Filed: Mar. 18, 1983

[51] Int. Cl.[3] ..... B41J 1/60

[52] U.S. Cl. ..... 400/175; 400/144.2

[58] Field of Search ..... 400/144.2, 144.3, 175; 403/359, 361, 366, 371, 372, 375, 290, 326; 285/DIG. 22

[56] References Cited

U.S. PATENT DOCUMENTS

| | | | |
|---|---|---|---|
| 2,611,632 | 9/1952 | Harris | 403/359 X |
| 3,011,794 | 12/1961 | Vaughn | 403/361 X |
| 3,820,739 | 6/1974 | Graf | 403/375 X |
| 3,885,851 | 5/1975 | Bennett | 403/290 X |
| 3,887,222 | 6/1975 | Hammond | 285/DIG. 22 X |
| 3,986,593 | 10/1976 | Orlens et al. | 400/144.2 |
| 4,049,110 | 9/1977 | Frechette | 400/144.2 X |
| 4,220,361 | 9/1980 | Brandenberg | 285/DIG. 22 X |
| 4,363,559 | 12/1982 | Suzuki et al. | 400/144.2 X |
| 4,403,876 | 9/1983 | Vought | 400/144.2 |

FOREIGN PATENT DOCUMENTS

| | | | |
|---|---|---|---|
| 58092 | 8/1982 | European Pat. Off. | 400/144.2 |

OTHER PUBLICATIONS

IBM Technical Disclosure Bulletin, "Print Disc Attachment," by McCray, vol. 18, No. 9, pp. 2988–2989, Feb. '76.

Xerox Disclosure Bulletin, "Retainer for Daisy Print Wheel" by Weisberg, vol. 2, No. 4, p. 41, Jul./Aug. '77.

*Primary Examiner*—Edgar S. Burr

*Assistant Examiner*—John A. Weresh

*Attorney, Agent, or Firm*—Roberts, Spiecens & Cohen

[57] ABSTRACT

Apparatus for releasably attaching a daisy print wheel to a splined shaft of an angular drive such that the print wheel can be driven in angular rotation with substantially no backlash. The apparatus comprises a splined hub fixed to the print wheel and slidably engageable with the splined shaft and a holder mounted on the hub for movement between a locking position in which the hub is locked on the splined shaft with interference fit and a released position in which the hub with the holder thereon is slidably removable from the splined shaft together with the print wheel. The hub includes a plurality of angular segments of cantilever formation which are pressed into the spaces between the splines on the drive shaft with interference fit by the engagement of the holder in its locking position. The holder is axially movable on the hub in traveling between the locking and release positions and is not normally removable from the hub.

25 Claims, 8 Drawing Figures

METHOD AND APPARATUS FOR MOUNTING A DAISY PRINT WHEEL ON THE SHAFT OF A PRINT HEAD

FIELD OF THE INVENTION

The invention relates to apparatus for attaching a daisy print wheel to a shaft of a print head with a low insertion force but with zero backlash.

The invention further relates to a method of attachment of the daisy print wheel to the print head.

PRIOR ART

There are numerous designs for the mounting of daisy print wheels on the shaft of a print head but the generally accepted practice is to key the print wheel to the shaft of the print head by means of a pin or square key. In order to reduce the backlash between the print wheel and the shaft of the print head, a very close tolerance must be maintained in the molding of the print wheel and in the machining of the key. Because the molding tolerance of the slot in the print wheel cannot be held closer than plus or minus 0.001 inches, it is customary to use an interference fit between the key and the slot. Although this assures no backlash, it makes installation of the wheel extremely difficult and sometimes causes "run-out" or wobble because the print wheel isn't fully seated against the shaft or hub of the print head.

SUMMARY OF THE INVENTION

An object of the invention is to provide means for attaching the print wheel to the drive shaft of the motor i.e. the print head with a low insertion force but with zero backlash between the print wheel and the shaft.

A further object of the invention is to achieve such attachment without interference fit between a key or pin and a slot.

Yet, another object of the invention is to achieve attachment of the print wheel with the shaft by means of interference fit but controlled in such manner as to make the engagement and disengagement of the print wheel with the shaft relatively simple and with minimal force.

Still another object of the invention is to achieve the interference fit by the deformation of cantilever elements.

Still another object of the invention is to provide an attachment between the print wheel and the shaft of the print head which can be easily released to permit separation of the print wheel from the shaft.

Still a further object of the invention is to provide a construction of the above type between the print wheel and the shaft which is of relatively simple construction and of low cost.

Another object of the invention is to provide such a construction which does not require careful machining of metal parts and can rely upon the use of relatively inexpensive parts of plastic material for the elements of the print wheel which engage shaft of the print head.

In accordance with the above and further objects of the invention, there is provided apparatus for attaching the print wheel to a drive shaft which comprises a hub fixed to the print wheel and engagable in driving relation with the drive shaft and holder means on the hub to secure the hub on the drive shaft in driving relation. The holder means and hub are cooperatively constructed and arranged to provide interference and engagement therebetween with resilient deformation in a locked position of the holder means and hub wherein said hub is engaged in driving relation with the drive shaft whereas, in an unlocked position, the resilient deformation is released and the holder means and hub are removable from the drive shaft.

According to a feature of the invention, the hub comprises a collet means which includes a plurality of slotted angular segments of cantilever formation and the holder means comprises a cap including sleeve means encircling the angular segments with interference fit in said locking position to hold the hub in driving relation on the drive shaft.

According to a further feature of the invention, the sleeve of the holder means is also formed with a plurality of slotted angular segments of cantilever formation and a spring is engaged around these latter elements.

A further object of the invention is to provide a method for mounting a print wheel on the a drive shaft of a print head.

In accordance with the method of the invention, a slidable cap is fitted on a hub of the print wheel and the print wheel with the cap on the hub thereof is axially slid on the drive shaft until the wheel is fully seated on the shaft and cannot undergo further slidable movement. Thereafter, the cap is axially forced on the hub of the now stationary print wheel to a displaced position in which interference engagement is produced with resilient deformation between the cap and hub and between the hub and drive shaft to lock the hub on the drive shaft in driving relation.

In further accordance with the invention as described above, the interference engagement between the hub and drive shaft is effected by bending cantilever elements of the hub against the drive shaft and, particularly, between splines on the drive shaft.

In further accordance with the invention as described above, the bending of the cantilever elements is effected by interference engagement between the cap and hub in which the cap applies radial force to the cantilever elements.

As a consequence of the above, the effort required to produce the interference fit is relatively small but large forces are produced in the interference engagement between the cantilever elements of the hub and the drive shaft. Thus, a high degree of reliability in the drive of the print wheel is obtained with no backlash.

DETAILED DESCRIPTION

Figure 1:
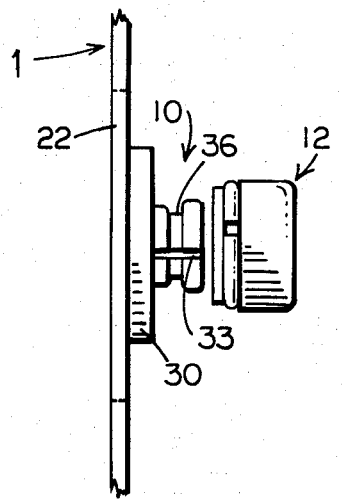
FIG. 1 is an exploded view of the hub of a print wheel and a holder means therefor.

Referring to FIGS. 1–4 of the drawing, therein is seen a conventional print wheel 1, particularly shown in the form of a daisy wheel which is to be attached to the shaft 2 of a motor 3 which is supported on a carrier (not shown) of a printer. As is conventional, the shaft of the motor 3 is driven in steps in order to position an appropriate petal 4 of the daisy wheel 1 so that a plunger 5 can be axially advanced to strike the petal and produce a corresponding indicia on a sheet of paper 6 placed against a fixed platen 7 through the intermediary of a ribbon 8.

In order to achieve printing in different styles, it is desirable to be able to replace the printing wheel 1 with other printing wheels having different formats and styles of the indicia on the petals. In order to achieve this, it is necessary for the print wheel to be easily removable and replaceable on the drive shaft 2. Moreover, it is essential that the print wheel be secured on the drive shaft in its operative position so as to closely follow the drive thereof without any backlash or angular freedom.

Figure 3:
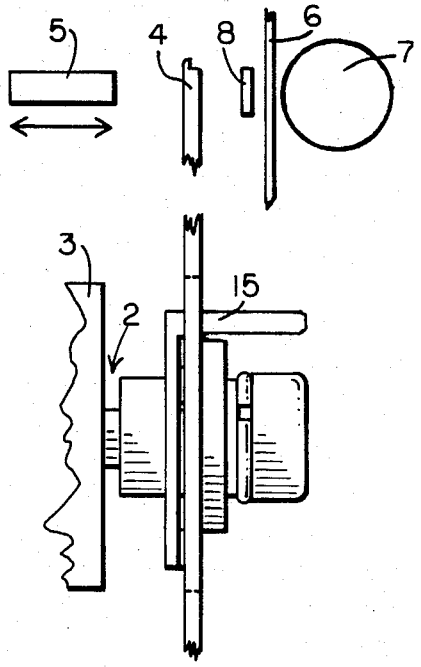
FIG. 3 is a side elevational view showing the assembly operatively locked on the drive shaft in a printing position.
Figure 4:
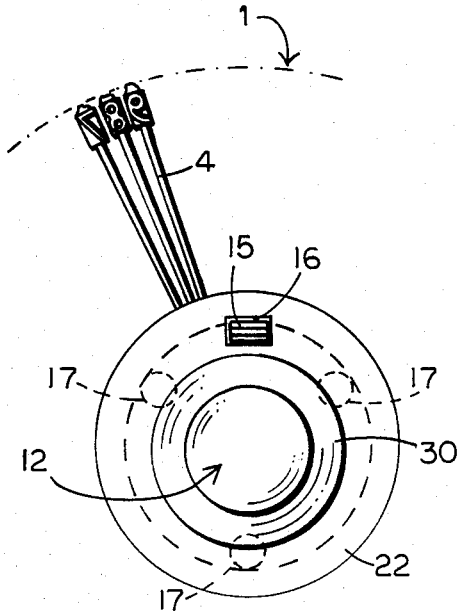
FIG. 4 is an end view of the assembly as seen from the right in FIG. 1.

For this purpose, the invention contemplates a novel construction of the print wheel including a hub 10 adapted to cooperate with a splined portion 11 of shaft 2 and a locking means 12 which serves to lock the hub 10 on the drive shaft in the operative position as shown in FIG. 3 and as will be explained in greater detail later. Fixed on the drive shaft 2 is a locating member 13 which serves as a guide to position the print wheel in relation to the plunger 5 and the platen 7. The attachment of the locating member 13 can be by any suitable conventional means, as for example, press or interference fit with a keyway or by fixed retention on the splines of spline portion 11. The locating member includes a cylindrical disc 14 with an axial locating finger 15 adapted to be loosely inserted into an opening 16 in the print wheel as evident from FIGS. 3 and 4. As shown in FIG. 4 the cross-section of the finger and receiving hole are rectangular but this can be of any other shape. A series of projections 17 are formed on the face of locating member 13 to face the print wheel and the free ends of the projections 17 lie in a plane to contact and hold the print wheel in its operative position.

Figure 8:
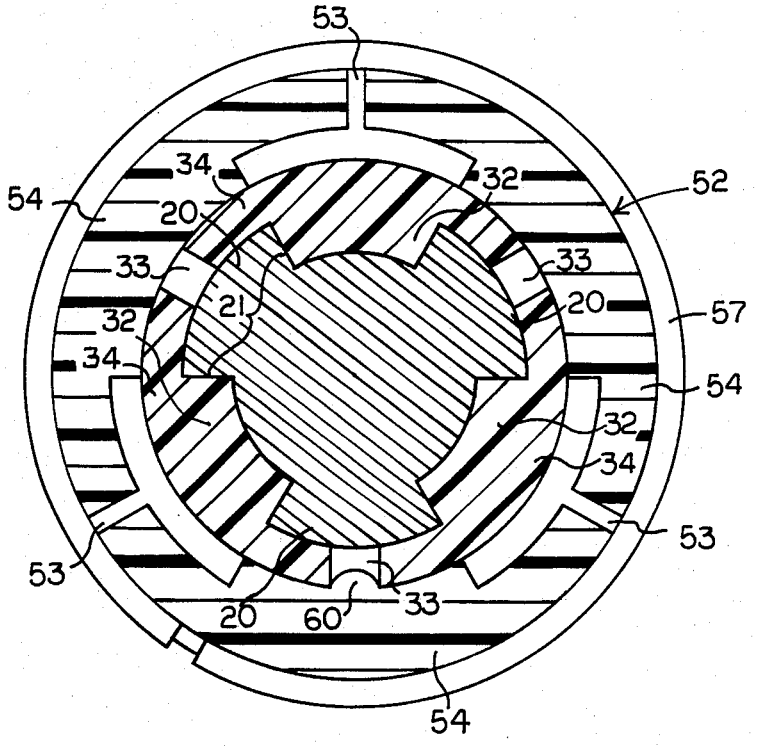
FIG. 8 is a sectional view taken on line 8—8 in FIG. 7.

The splined portion 11 of the shaft 2 is shown in FIG. 8 as including three splines 20 arranged at equal angular intervals on the shaft and a greater or lesser number can be used according to specific circumstances. As shown, each of the splines has angulated flanks 21 such that each spline widens outwardly. The shaft is made of hardened steel.

The hub 10 is made of a relatively hard synthetic resin material such as PVC which has flexibility for a purpose which will become evident later. The hub 10 is secured to a central portion 22 of the print wheel, for example, by suitable adhesives. In a modification, the print wheel and hub can be integrally molded if this is considered expedient. The print wheel 1 has a central bore 23 which is surrounded by a metal ring 24 of an inner diameter which loosely fits around the splined portion 11 of the drive shaft.

The hub 10 comprises a cylindrical disc portion 30 (whose rear face is adhesively secured to the front face of the print wheel 1) and a cylindrical portion 31 which is integrally formed with the disc portion 30 to extend therefrom in coaxial relation therewith. The cylindrical portion 31 of the hub 10 includes a plurality of internal axial projections 32 of a number equal to the number of spaces between the splines 20. As shown in FIG. 8, there are three projections 32 which fit between the splines and are in correspondence with the shape of the spaces between the splines on the shaft 2. Three axial slots 33 extend at equal angular intervals in the cylindrical portion 31 to form three angular segments 34 extending in cantilever formation from the cylindrical disc portion 30. Effectively, the angular segments 34 of cantilever formation form a collet means whose internal projections 32 fit within the spaces between the splines 20 of the drive shaft. Because of the flexibility of the material of the hub 10, the angular segments 34 are capable of undergoing bending as cantilever elements from the disc portion 30. The internal projections 32 are dimensioned in relation to the spaces between the splines 20 so as to be loosely fit in these spaces whereby the hub is easily engaged on the splined shaft with substantially no resistance and is capable of free axial slidable movement on the splined portion. However, when the segments 34 are bent inwardly as will be explained later, the projections 32 become tightly fitted in the spaces between the splines due to the inclination of flanks 21 and a locking engagement is obtained in which all free play is taken up.

Figure 7:
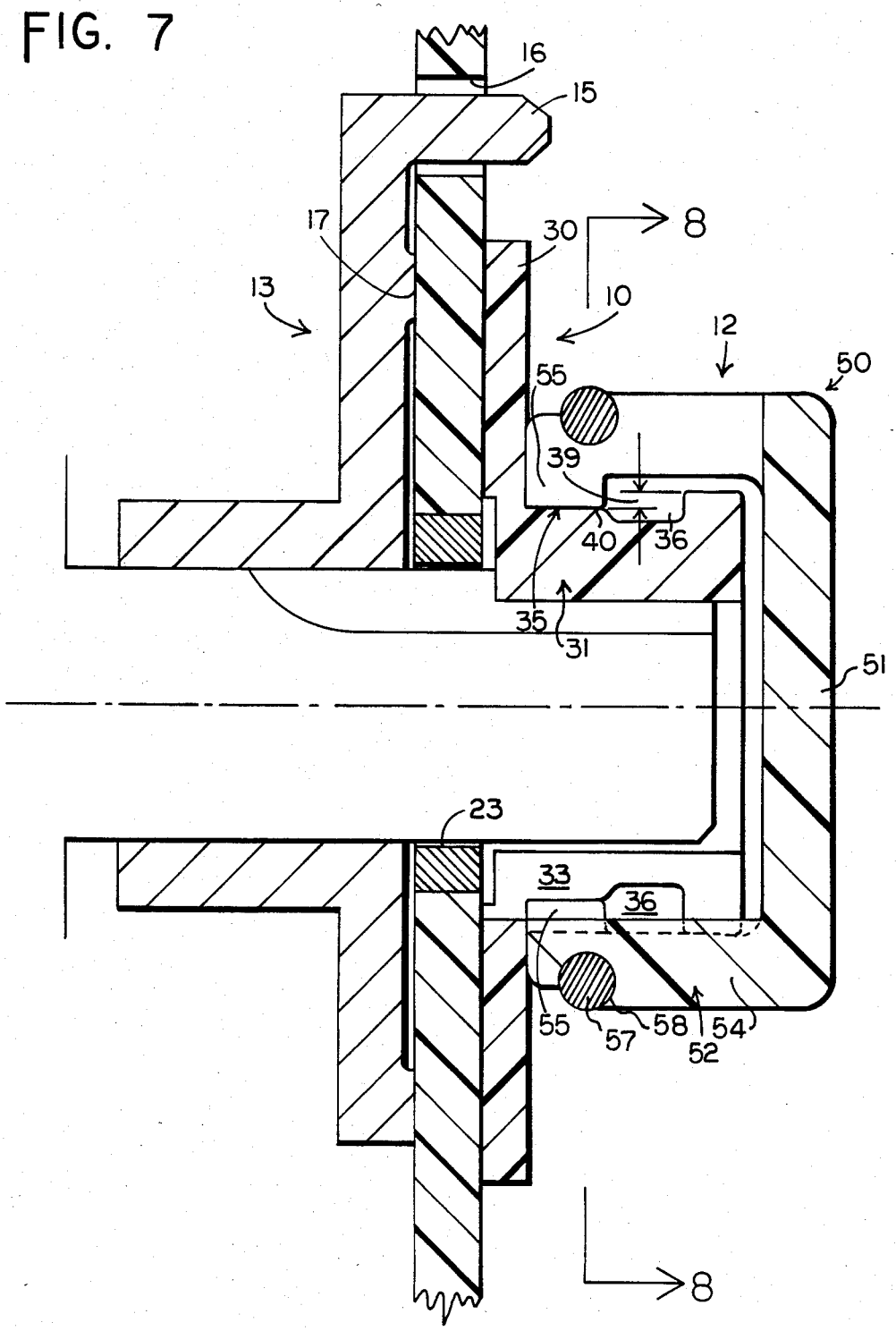
FIG. 7 is a longtiduinal sectional view of the construction in which the assembly is locked on the drive shaft.

The external surface of the portion 31 of hub 10 is formed with annular groove 36 whose rear wall 37 is higher than its front wall 38 by an amount shown as dimension 39 in FIG. 7 whereby the rear wall forms a ridge to retain the holder means 12 in non-removable fashion as will be evident later. As a result of the construction, the outer surface 35 of the cylindrical portion 31 of hub 10 has three different sections of different level, namely, front section 40, section 41 at the bottom of groove 36 and section 42 at the rear of the cylindrical portion 31.

The holder means 12 is in the form of a cap 50 composed of a synthetic resin material similar to that of the hub 10 and, more particularly, rigid PVC. As with hub 10, the cap 50 will possess flexibility for a purpose to be evident later. The cap 50 includes a cylindrical end closure 51 and a projecting tubular sleeve 52 integral with end 51. The sleeve 52 is formed with three equally spaced axial slots 53 located at angular positions corresponding to the center of the spaces between the splines 20 of the drive shaft. The slots 33 in the cylindrical portion 31 of the hub 10 are located at angular positions corresponding to the centers of the splines and therefore, the slots 33 and 53 are offset by angles of 45° from one another. The slots 53 form angular cantilever segments 54 on the sleeve 52 of the cap 50. The cantilever segments 54 are therefore free to bend in accordance with the flexibility of the material of the cap with respect to the cylindrical end 51. At their free ends the cantilever segments 54 carry internal lugs 55 extending over a portion of the angular extent of cantilever segments 54 as evident from FIG. 8. The cap 50 is non-removably secured to the hub 10 by engagement of the lugs 55 beyond the rear wall 37 of the groove 36 formed in the outer surface of the hub 10. In order to assemble the cap 50 on the hub 10, it is necessary to apply substantial force axially in order to produce sufficient deflection of the cantilever segments 54 so that the inner surfaces of the lugs 55 will ride over the section 42 and engage into the groove 36 of the hub 10. Once this has been achieved, removal of the cap 50 from the hub 10 is substantially foreclosed.

The inner diameter defined by lugs 55 is smaller than the outer diameter of the surface 35 of hub 10 at section 40. In the position shown in FIG. 5, the lugs 55 are loosely received in the groove 36 and, hence, the assembly of the cap 12 on the hub 10 is capable of being readily displaced axially on the splines of the drive shaft from the position in FIG. 5 to the of FIG. 6 and back again to FIG. 5. However, axial displacement of the cap 50 from the position in FIG. 6 to that in FIG. 7, will produce interference between the inner surface of lugs 55 and the outer surface 35 of the hub 10 at section 40. This will cause inward bending of the cantilever sections 34 of the hub 10 which will tightly engage the projections 32 between the splines of the drive shaft to take-up any looseness therebetween. As a consequence, angular drive of the drive shaft will cause the hub 10 to follow therewith without any backlash. The effort to deform the cantilever elements 34 is minimal due to the fact that these are capable of being bent under resilient deformation with minimal interference fed between the lugs 55 and the section 40 of the hub 10. A spring of circlip 57 is seated in a groove 58 formed in the outer surface of cap 50 to apply resilient force against the cantilever segments 54 to hold the lugs 55 in position so that when the lubs are advanced on section 40 of the hub 10, this will produce the desired interference fit and consequent bending of cantilever segments 34 of the hub into resilient engagement with the flanks of the splines of the drive shaft. As previously indicated, the cantilever segments 34 serve as the collet means and the lugs 55 act to resiliently deform the collet means to provide the resilient deformation of the cantilever segments 34 and the interference fit with the splines of the drive shaft. Effectively, the engagement of the lugs 55 in the groove 36 in the position as shown in FIG. 6, serves as an unlocked, released position in which the assembly of the cap 50 on the hub 10 can be freely slidably engaged on the splines of the drive shaft while the engagement of the lugs 55 on section 40 of the hub, as shown in FIG. 7, serves as a lock position in which the hub is locked on the splined shaft with interference fit for driving engagement between the hub and splined shaft with no backlash. Because of the construction of the interferring elements of the hub and cap as cantilever segments, the force required by the operator in going between the locked position as shown in FIG. 7 and the release position as shown in FIG. 6, is relatively minimal.

In order to prevent relative rotation between the cap 50 and the hub 10 in the release position of FIG. 6, the internal surface of a selected one of the cantilever segments 54 is provided with a rib 60 which, as seen in FIG. 8, engages within a slot 33 formed in the hub 10.

Although it is expected that the height of the rear wall 37, bounding groove 36 in the external surface of hub 10 will be sufficient to prevent axial removal of the cap 12 from the hub 10, the outer surface 61 of the cap 50 is made smooth without any irregularities in order to avoid any projections by which the cap 50 can be pried from the hub 10. The presence of the spring 57 also precludes removal of the cap 50 from the hub 10. If replacement of a damaged or defective cap 50 is necessary, then the spring 57 must be removed from the groove 58 and thereafter, the cap must be forceably removed from the hub. In ordinary operation, however, this will not be within the capabilities of the regular user.

Figure 2:
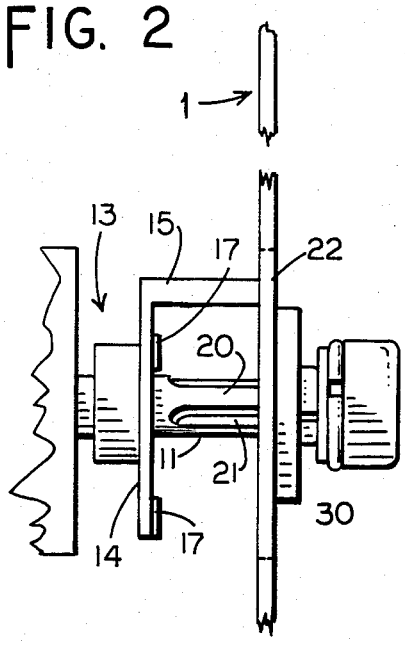
FIG. 2 is a side elevational view showing the holder means assembled on the hub of the print wheel, the assembly being placed on a splined drive shaft of a motor.
Figure 5:
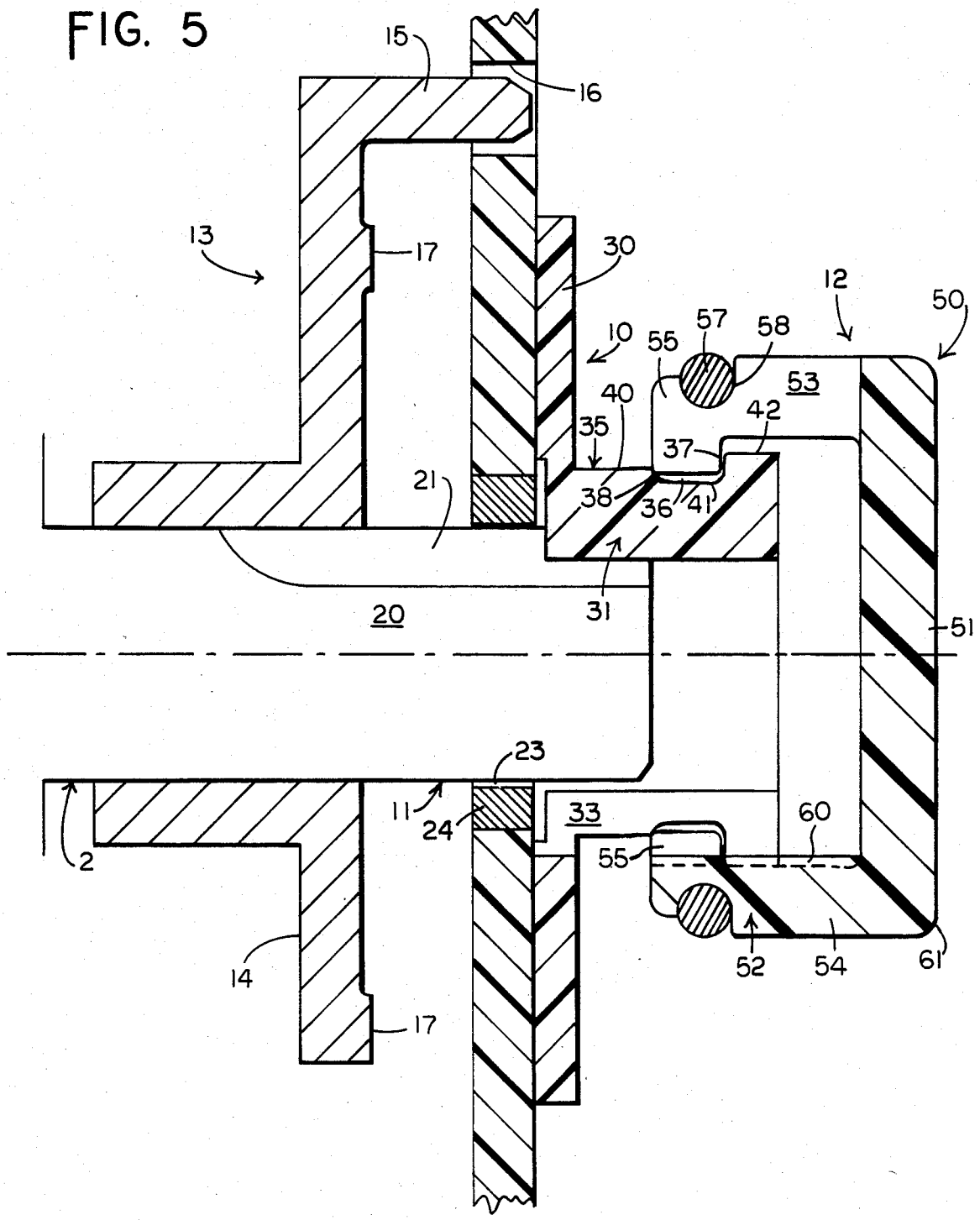
FIG. 5 is a longitudinal sectional view of a portion of the construction as shown in the position of FIG. 2 on enlarged scale.
Figure 6:
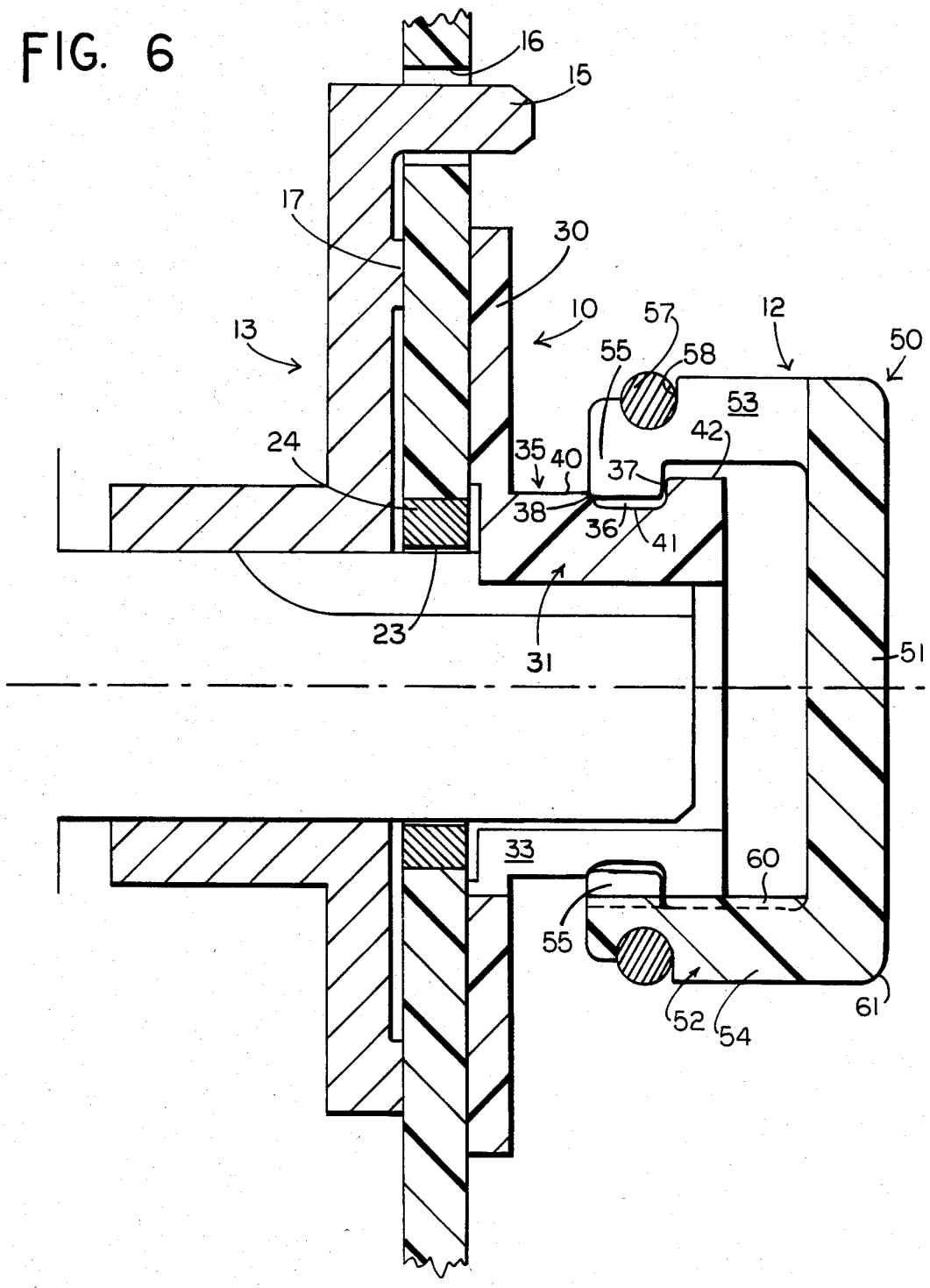
FIG. 6 is a longitudinal sectional view of the construction in a position in which the assembly of the hub and holder means has been advanced axially.

In operation, a selected print wheel having the desired indicial characteristics thereon, is slidably inserted onto the splined portion 11 of the drive shaft 2 as shown in FIGS. 2 and 5 and the assembly of the print wheel with its hub and cap is axially advanced on the splined shaft until the finger 15 of the locating member 13 is loosely fitted within the hole 16 of the print wheel. When the rear face of the print wheel comes into contact with the end faces of the projections 17 on the locating member, the print wheel is prevented from undergoing any further displacement along the splined shaft. Continued application of pressure on the cap 50 will cause the cap to be displaced axially from the released position as shown in FIG. 6 to the locked position as shown in FIG. 7. In this position, the print wheel is now secured to the drive shaft for angular travel therewith without backlash. In order to replace the print wheel with a different print wheel, it is only necessary to reverse the procedure and, in this regard, the operator holds the print wheel against the projections 17 and applies axial pulling force to the cap 50 to axially move the cap from the locked position to the release position. The assembly of the print wheel with its hub and the cap on the hub is now removable from the splined shaft so that a different print wheel can be applied thereto.

Although the invention has been described in conjunction with a specific embodiment thereof, it will become apparent to those skilled in the art that numerous modifications and variations can be made within the scope and spirit of the invention as defined in the attached claims.

What is claimed is:

1. Apparatus for attaching a print wheel to an angular drive means, said apparatus comprising a hub fixed to the print wheel and engagable in driving relation with the angular drive means such that rotation of the drive means imparts corresponding rotation to the print wheel, and holder means on said hub to secure the hub on the angular drive means in said driving relation, said holder means and hub being cooperatively constructed and arranged to provide interference engagement therebetween with resilient deformation in a locked position of said holder means and hub with said hub engaged in driving relation with said drive means whereas in an unlocked position the resilient deformation is released and the holder means and hub are removable from the drive means, said hub comprising a collet means, said holder means comprising a cap including sleeve means lockably engageable on the collet means with interference engagement and resilient deformation to secure the hub on the drive means, said drive means comprising a drive shaft with splines thereon, said collet means including angular segments of cantilever formation engaged between the splines of the drive shaft with interference fit when the sleeve means is lockably engaged on the collet means in interference engagement.

2. Apparatus as claimed in claim 1 wherein said sleeve means includes a sleeve with internal lug means for lockably engaging said segments.

3. Apparatus as claimed in claim 2 wherein said hub has an external surface with rib means thereon for cooperatively engaging with said internal lug means in said sleeve means to produce said interference engagement between the hub and holder means.

4. Apparatus as claimed in claim 3 wherein said sleeve is provided with axial slots to define flexible angular sleeve segments, said rib means being on said sleeve segments.

5. Apparatus as claimed in claim 4 comprising spring means externally on said sleeve urging said sleeve segments against said hub.

6. Apparatus as claimed in claim 5 wherein said sleeve is provided with an external groove in which said spring means is seated.

7. Apparatus as claimed in claim 4 comprising means on said hub and holder means for holding the same in angular secured relation when the holder means is engaged on said hub.

8. Apparatus as claimed in claim 7 wherein the means for holding the hub and holder means in angular secured relation comprises a lug and groove engagement between the hub and holder means.

9. Apparatus as claimed in claim 1 wherein said cap is movable on said hub between a first position of interference engagement therebetween in which the holder means and hub are in said locked position and a second release position in which said hub and holder means are removable from the drive means.

10. Apparatus as claimed in claim 9 wherein said hub has an external surface with a groove therein, said sleeve means including internal lug means received in said groove on said release position and seated on said external surface outside said groove in said locked position.

11. Apparatus as claimed in claim 10 comprising a ridge on said hub bounding said groove to prevent removal of said cap from said hub.

12. Apparatus as claimed in claim 11 wherein said cap has an externally smooth surface to oppose engagement thereof for prying said cap from the hub.

13. Apparatus as claimed in claim 12 wherein said print wheel is a daisy print wheel.

14. A method of mounting a print wheel on a splined drive shaft comprising fitting a slidable cap on a hub of the print wheel, sliding the print wheel with the cap axially on the splined drive shaft until the wheel is fully seated on the shaft and can not undergo further slidable movement, and forcing the cap axially on the hub of the now stationary print wheel to produce interference engagement with resilient deformation between the cap and hub and between the hub and drive shaft to lock the hub on said drive shaft, the interference engagement between the hub and drive shaft being effected by bending cantilever elements of said hub between splines on said drive shaft.

15. A method as claimed in claim 14 wherein the bending of said cantilever elements is effected by interference engagement between the cap and hub in which the cap applies radial force to the cantilever elements.

16. The combination comprising a splined drive shaft, a print wheel including a hub on said drive shaft and a holder means non-removably supported on said hub for movement between a first position in which the hub is drivingly disengaged from the drive shaft and can be removed therefrom with said holder means, and a second position in which interference engagement with resilient deformation is produced between said holder means and said hub and between said hub and said drive shaft to lock the hub on said drive shaft in coupled driving engagement, said holder means being axially slidable on said hub between said first and second positions, said hub comprising a collet means including a plurality of slotted angular segments of cantilever formation fitted between the splines of said drive shaft, said cap including a sleeve encircling said angular segments and engaged therewith in interference fit in said second position to lock said segments between said splines.

17. The combination as claimed in claim 16 wherein said sleeve includes internal lug means for engaging said angular segments.

18. The combination as claimed in claim 16 comprising means on said hub and cap for holding the same in angular secured relation.

19. The combination as claimed in claim 16 wherein said splines have inclined flanks and said angular segments of cantilever formation have inclined surfaces engaging said flanks with increasing intensity as said segments engage said splines to produce said interference fit.

20. Apparatus for releasably attaching a print wheel to a splined shaft adapted to drive the print wheel in angular rotation, said apparatus comprising a splined hub fixed to a print wheel and slidably engageable with said splined shaft, and a holding means mounted on said hub for movement between a first locking position in which the hub is locked on the splined shaft with interference fit for driving engagement between the hub and splined shaft with no backlash, and a second release position in which the hub with the locking means thereon is slidably removable from said shaft together with said print wheel, said hub including a plurality of cantilever elements engaging the splined shaft, said holding means in said locking position bending said cantilever elements into resilient engagement with said splined shaft to produce said interference fit.

21. Apparatus as claimed in claim 20 wherein said holding means includes lug means for bending said cantilever elements as said holding means is moved to said first locking position.

22. Apparatus as claimed in claim 21 wherein said holding means is axially movable on said hub when traveling between said first and second positions.

23. Apparatus as claimed in claim 20 comprising means for non-removably supporting said holding means on said hub.

24. Apparatus as claimed in claim 20 comprising means for mounting the holding means on the hub in angular secured relation thereon.

25. Apparatus as claimed in claim 20 wherein said hub has opposite ends, said print wheel being at one of said ends, said first locking position being closer to said one end than in said second release position.

* * * * *